US005396740A

United States Patent [19]

Bocchi

[11] Patent Number: 5,396,740

[45] Date of Patent: Mar. 14, 1995

[54] PHOTOLUMINESCENT HANDRAIL, HANDHOLD OR THE LIKE

[75] Inventor: Giuseppe Bocchi, Milan, Italy

[73] Assignee: Bocchi S.R.L., Milan, Italy

[21] Appl. No.: 186,799

[22] Filed: Jan. 25, 1994

[30] Foreign Application Priority Data

Feb. 9, 1993 [IT] Italy ..... MI93U0100

[51] Int. Cl.[6] ..... E04F 11/08; E04F 11/18

[52] U.S. Cl. ..... 52/33; 52/105; 248/251; 256/59; 256/65; 182/18; 182/106

[58] Field of Search ..... 256/65, 59; 248/251; 52/27, 33, 182, 105; 182/18, 106

[56] References Cited

U.S. PATENT DOCUMENTS

| | | | |
|---|---|---|---|
| 302,773 | 7/1884 | Peters | 248/251 |
| 634,936 | 10/1899 | Brown | 248/251 |
| 4,953,830 | 9/1990 | Weaver | 256/59 X |
| 5,020,256 | 6/1991 | French | 40/661 |
| 5,065,837 | 11/1991 | Szudy | 182/18 |
| 5,165,643 | 11/1992 | Shreiner | 248/251 |
| 5,288,048 | 2/1994 | Shreiner | 248/251 |

*Primary Examiner*—Carl D. Friedman
*Assistant Examiner*—Robert J. Canfield
*Attorney, Agent, or Firm*—Wolf, Greenfield & Sacks

[57] ABSTRACT

A handrail including one or more tubular members, the ends whereof are provided with respective fastening members. Inserts made of photoluminescent material are arranged between the tubular members and the fixing members and are suitable to make the handrail visible even in poor lighting conditions or in complete darkness.

8 Claims, 1 Drawing Sheet

PHOTOLUMINESCENT HANDRAIL, HANDHOLD OR THE LIKE

BACKGROUND OF THE INVENTION

1. Field of the Invention

The present invention relates to a handrail, handhold or the like.

2. Description of the Prior Art

As is known, handrails, handholds or the like serve as safety support on stairs, in corridors, in bathrooms and in essential passageways of houses, hospitals, homes for senior citizens, institutions for the disabled and communities of all kinds.

A strongly felt problem is to make the handrails visible even in poor lighting conditions, especially for persons with impaired visual and motor abilities.

the aim of the present invention is to provide a handrail which can be detected immediately in poor lighting conditions or in complete darkness.

Within the scope of this aim, an object of the invention is to provide a handrail which is visible in the dark without using electric power and is therefore economical from the point of view of management and absolutely reliable even in case of power failure.

Another object is to provide a handrail which is economical from the point of view of production and which is installed as easily as for conventional ones.

SUMMARY OF THE INVENTION

This aim, these objects and others which will become apparent hereinafter are achieved by a handrail, handhold or the like which includes at least one tubular member the ends of which are respectively connected to members for fixing to a wall or the like, characterized in that it includes at least one insert or band arranged between the at least one tubular member and one of the fixing members, or in the connecting points of tubular members, the insert or band comprising at least one visible part which is constituted by photoluminescent material.

Further characteristics and advantages will become apparent from the description of the handrail, which is illustrated only by way of non-limitative example in the accompanying drawings, wherein:

DESCRIPTION OF THE PREFERRED EMBODIMENT OF THE INVENTION

Figure 2:
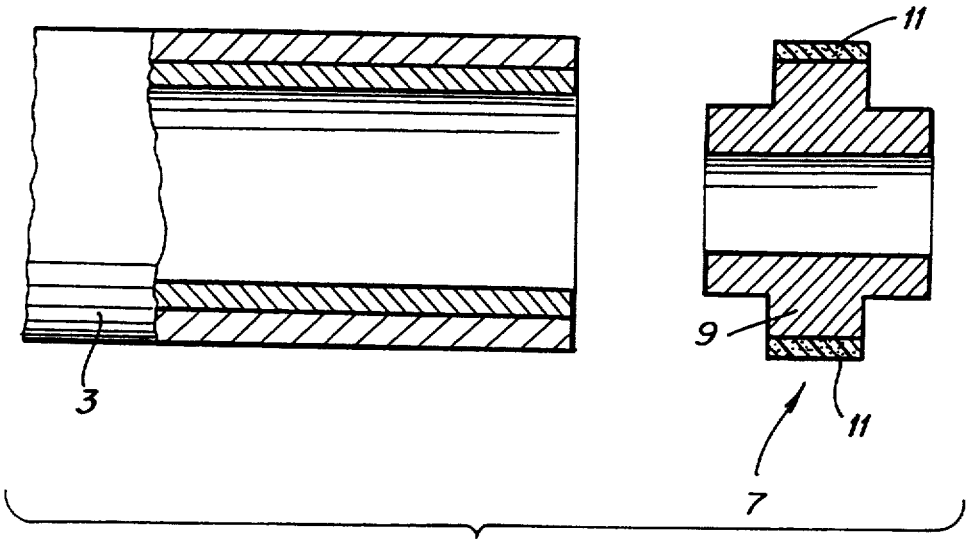
FIG. 2 is a partial exploded sectional view of an insert and of an end of a tubular member.
Figure 3:
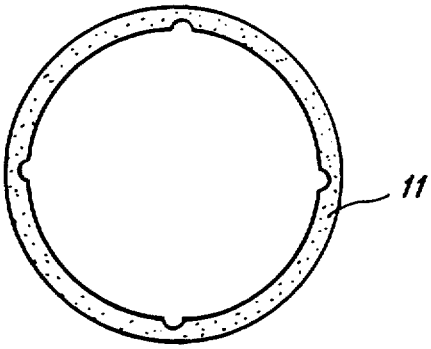
FIG. 3 is a detail front view of a ring made of photoluminescent material, suitable to constitute the visible layer of the insert.
Figure 1:
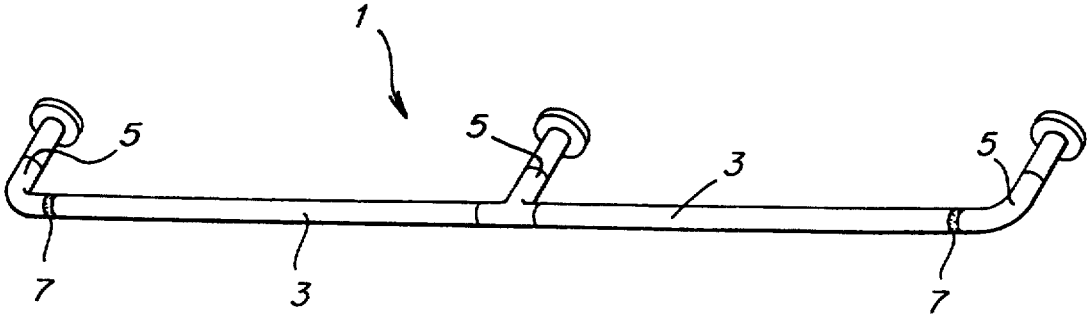
FIG. 1 is a perspective view of a handrail according to the invention.

With reference to the above figures, a handrail or handhold, generally designated by the reference numeral 1, includes two tubular members 3. Fixing members 5 are adapted to fasten the handrail for example to a wall, and are connected to the ends of the tubular members.

According to the invention, an insert 7 is arranged between the ends of the tubular member and the respective fixing member.

The insert 7 is tubular and includes a central annular portion 9 which is suitable to support a ring 11 which constitutes the visible layer of the insert and is perfectly complementary to the external profile of the tubular member 3 and of the fixing members 5.

The ring 11 is made of photoluminescent material, for example photoluminescent nylon. Photoluminescence is the luminescence phenomenon due to which some materials are capable of absorbing light energy and of emitting light for a certain period of time which is proportional to the time for which they have been exposed to light.

In normal lighting conditions, the insert appears as a yellow collar which becomes very bright in poor lighting conditions.

In practice it has been observed that the invention achieves the intended aim and objects, providing a handrail which has light-emitting bands which are particularly visible in the grip points.

An advantage of the invention is the fact that the handrail requires no maintenance or checking, since it has no electrical or mechanical devices for generating light at night.

Naturally, the materials employed, as well as the dimensions, may be any according to the requirements and the state of the art.

I claim:

1. A handrail comprising:

at least one tubular member having ends;

fixing members constructed and arranged for fixing to a supporting surface and said fixing members supporting the tubular member;

wherein at least one of the ends includes an insert thereon that engages one of said fixing members, said insert comprising at least one visible part of photoluminescent material.

2. Handrail according to claim 1, wherein said photoluminescent material is photoluminescent nylon.

3. Handrail according to claim 1, wherein said insert has an external profile which is complementary to the external profile of said at least one tubular member and of said fixing members.

4. Structure according to claim 1, wherein said insert is tubular and comprises a central annular portion which supports said photoluminescent material and annular end portions which have a smaller diameter and are suitable to fit respectively in said at least one tubular member and in one of said fixing members.

5. A handrail comprising:

a pair of tubular members having ends;

an insert attached to one of the ends of each tubular member;

at least a pair of fixing members supporting the tubular members relative to a supporting surface wherein each said insert comprises at least one visible part that includes photoluminescent material.

6. A handrail comprising:

a tubular member having ends;

an insert attached to one of the ends of the tubular member;

at least a pair of fixing members supporting the tubular member relative to a supporting surface, wherein said insert comprises at least one visible part that includes photoluminescent material.

7. A handrail according to claim 6; wherein the insert is positioned between and engages one of the fixing members and one of the ends of the tubular member.

8. A handrail according to claim 6; wherein the insert defines an outer perimeter that is substantially flush with the outer perimeter of the handrail.

* * * * *